US008550184B2

(12) United States Patent
Buchanan et al.

(10) Patent No.: US 8,550,184 B2
(45) Date of Patent: Oct. 8, 2013

(54) FORMATION CORING APPARATUS AND METHODS

(75) Inventors: Steven E. Buchanan, Pearland, TX (US); Julian J. Pop, Houston, TX (US); Carsten Sonne, Houston, TX (US); Gokhan Erol, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 457 days.

(21) Appl. No.: 12/775,920

(22) Filed: May 7, 2010

(65) Prior Publication Data

US 2010/0282516 A1 Nov. 11, 2010

Related U.S. Application Data

(63) Continuation-in-part of application No. 11/934,103, filed on Nov. 2, 2007, now Pat. No. 8,061,446.

(60) Provisional application No. 61/176,574, filed on May 8, 2009, provisional application No. 61/187,126, filed on Jun. 15, 2009, provisional application No. 61/320,579, filed on Apr. 2, 2010.

(51) Int. Cl.
*E21B 49/00* (2006.01)
*E21B 25/00* (2006.01)

(52) U.S. Cl.
USPC ..... 175/58; 175/249

(58) Field of Classification Search
USPC ..... 175/58, 20, 77, 78, 38, 40, 99
See application file for complete search history.

(56) References Cited

U.S. PATENT DOCUMENTS

| | | | | |
|---|---|---|---|---|
| 2,372,875 | A | 4/1945 | Benke | |
| 2,546,670 | A | 3/1951 | Kirby | |
| 3,353,612 | A * | 11/1967 | Bannister | 175/6 |
| 3,430,716 | A | 3/1969 | Urbanosky | |
| 3,677,081 | A | 7/1972 | Newton et al. | |
| 4,317,993 | A | 3/1982 | Hertzog, Jr. et al. | |
| 4,354,558 | A * | 10/1982 | Jageler et al. | 175/45 |
| 4,396,074 | A * | 8/1983 | Jageler et al. | 175/78 |
| 4,461,360 | A | 7/1984 | Mount, II | |
| 4,468,623 | A | 8/1984 | Gianzero et al. | |

(Continued)

FOREIGN PATENT DOCUMENTS

| | | |
|---|---|---|
| DE | 1484592 | 5/1969 |
| WO | 03040743 | 5/2003 |

(Continued)

OTHER PUBLICATIONS

Newberry, B.M. et al., Analysis of Carbonate Dual Porosity Systems from Borehole Electrical Images, SPE 35158, Midland, Texas, Mar. 27-29, 1996.

*Primary Examiner* — David Bagnell
*Assistant Examiner* — James Sayre
(74) *Attorney, Agent, or Firm* — Cathy Hewitt; John Vereb

(57) ABSTRACT

Methods comprising: lowering a downhole tool into a wellbore extending into a subterranean formation, wherein the downhole tool comprises a coring tool and a measurement tool; performing a measurement regarding the formation using the measurement tool; determining a section of interest within the formation relative to an axis of the coring tool based on the measurement; orienting a coring bit of the coring tool relative to the section of interest; and extending the oriented coring bit into the formation.

14 Claims, 9 Drawing Sheets

(56) References Cited

U.S. PATENT DOCUMENTS

| | | | | |
|---|---|---|---|---|
| 4,638,872 | A * | 1/1987 | Park et al. | 175/46 |
| 4,704,581 | A | 11/1987 | Clark | |
| 4,714,119 | A | 12/1987 | Hebert et al. | |
| 4,860,581 | A | 8/1989 | Zimmerman et al. | |
| 4,936,139 | A | 6/1990 | Zimmerman et al. | |
| 5,021,653 | A | 6/1991 | Roscoe et al. | |
| 5,115,872 | A | 5/1992 | Brunet et al. | |
| 5,235,285 | A | 8/1993 | Clark et al. | |
| 5,411,106 | A * | 5/1995 | Maissa et al. | 175/78 |
| 5,439,065 | A | 8/1995 | Georgi et al. | |
| 5,482,122 | A | 1/1996 | Abass et al. | |
| 5,617,927 | A * | 4/1997 | Maissa | 175/78 |
| 5,663,559 | A | 9/1997 | Auzerais et al. | |
| 5,667,025 | A | 9/1997 | Haessly et al. | |
| 6,006,844 | A | 12/1999 | Van Puymbroeck et al. | |
| 6,191,588 | B1 | 2/2001 | Chen | |
| 6,371,221 | B1 | 4/2002 | Harrigan et al. | |
| 6,672,407 | B2 | 1/2004 | Streich | |
| 6,678,616 | B1 | 1/2004 | Winkler et al. | |
| 6,894,499 | B2 | 5/2005 | Dumont et al. | |
| 7,073,378 | B2 | 7/2006 | Smits et al. | |
| 7,191,831 | B2 | 3/2007 | Reid et al. | |
| 7,236,887 | B2 | 6/2007 | Wang et al. | |
| 7,303,011 | B2 | 12/2007 | Reid et al. | |
| 7,789,170 | B2 | 9/2010 | Church | |
| 2004/0140126 | A1 | 7/2004 | Hill et al. | |
| 2005/0133267 | A1 | 6/2005 | Reid, Jr. et al. | |
| 2006/0081398 | A1 | 4/2006 | Arian et al. | |
| 2007/0045005 | A1 * | 3/2007 | Tchakarov et al. | 175/20 |
| 2007/0137894 | A1 | 6/2007 | Fujisawa et al. | |
| 2009/0025941 | A1 | 1/2009 | Iskander et al. | |
| 2009/0066336 | A1 | 3/2009 | Dion | |
| 2009/0114447 | A1 | 5/2009 | Reid, Jr. et al. | |

FOREIGN PATENT DOCUMENTS

| | | |
|---|---|---|
| WO | 2005086699 | 9/2005 |
| WO | 2007039025 | 4/2007 |
| WO | 2009064732 | 5/2009 |

* cited by examiner

FORMATION CORING APPARATUS AND METHODS

CROSS-REFERENCE TO RELATED APPLICATIONS

The present application is a continuation-in-part of, and therefore claims benefit under 35 U.S.C. §120 to, U.S. patent application Ser. No. 11/934,103, filed on Nov. 2, 2007 now U.S. Pat. No. 8,061,446, and titled "Coring Tool and Method," the entirely of which is hereby incorporated herein by reference.

The present application also claims priority to U.S. Provisional Patent Application No. 61/176,574, filed on May 8, 2009, and titled "Sealed Core," the entirely of which is hereby incorporated herein by reference.

The present application also claims priority to U.S. Provisional Patent Application No. 61/187,126, filed on Jun. 15, 2009, and titled "Sealed Core," the entirely of which is hereby incorporated herein by reference.

The present application also claims priority to U.S. Provisional Patent Application No. 61/320,579, filed on Apr. 2, 2010, and titled "Formation Coring Apparatus and Methods," the entirely of which is hereby incorporated herein by reference.

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a drill string. Drilling fluid, or mud, is typically pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a borehole. For example, certain formation evaluation schemes include measurement and analysis of the formation pressure and permeability. These measurements may be essential to predicting the production capacity and production lifetime of the subsurface formation.

While formation testing tools may be primarily used to collect fluid samples, other downhole tools may be used to collect core samples. For example, a coring tool may be used to obtain a core sample of the formation rock. The typical coring tool includes a hollow coring bit that is advanced into the formation to define a core sample which is then removed from the formation. The core sample may then be analyzed in the tool in the borehole or after being transported to the surface, such as to assess the reservoir storage capacity (porosity) and the permeability of the material that makes up the formation surrounding the borehole, the chemical and mineral composition of the fluids and mineral deposits contained in the pores of the formation, and/or the irreducible water content contained in the formation, among other things.

However, traditional coring tools are limited to obtaining sidewall core samples perpendicular to the longitudinal axis of the coring tool (or equivalently the wellbore axis), because the coring bit cannot be independently tilted and extended into the formation at an angle other than 90 degrees relative to the coring tool axis. Consequently, for laminated formations that exhibit anisotropy, where the intrinsic formation properties depend on a direction of measurement, a core sample extracted at a 90 degree angle must be subsequently cut along lines of anisotropy. The resulting sample is often not suitable for measurement of the desired formation property.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
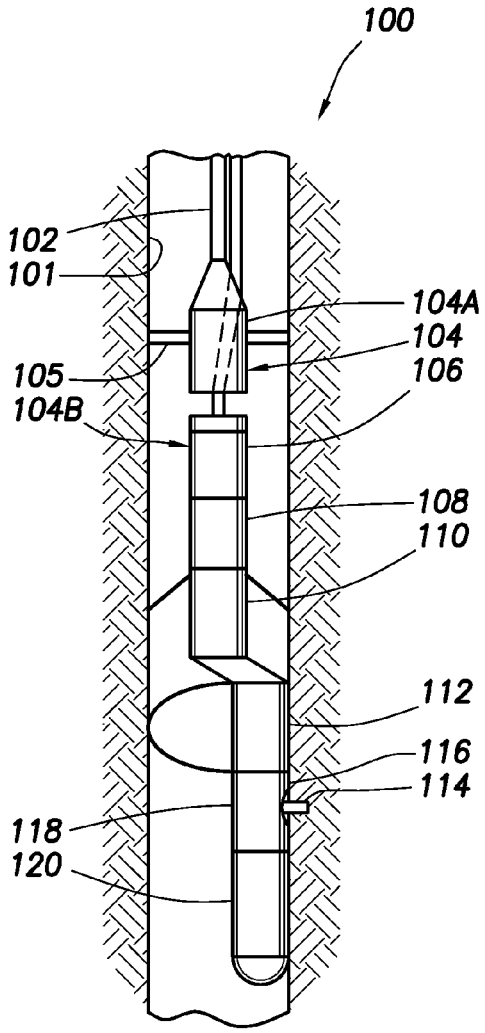
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a schematic view of a tool string 100 according to one or more aspects of the present disclosure. The tool string 100 is suspended in a wellbore at the end of a wireline cable 102. The cable 102 is spooled on a winch (not shown) at the Earth's surface. The cable 102 may provide electrical power to various components included in the tool string 100 and/or a data communication link between various components in the tool string 100 and a surface electronics and processing system (not shown). The tool string 100 comprises a sidewall coring tool 114 according to one or more aspects of the present disclosure. The tool string 100 may also comprise an anchor and power sub 104, a telemetry tool 106, an inclinometry tool 108, a near wellbore imaging tool 110, and a lithology analysis tool 112.

Example descriptions of the anchor and power sub 104 may be found in U.S. Patent Publication No. 2009/0025941, which is incorporated herein by reference in its entirety. For example, the anchor and power sub 104 may comprise two sections. A first section 104A may comprise an anchor 105 configured to secure the first section 104A with respect to the wellbore wall 101, as shown, and a power mechanism (not shown) to controllably translate and/or rotate a second section 104B via an arm. The telemetry tool 106, the inclinometry tool 108, the near wellbore imaging tool 110, the lithology tool 112, and/or the coring tool 114 may be attached to the second section 104B of the anchor and power sub 104. The anchor and power sub 104 may also include one or more sensors (e.g., linear potentiometers) configured to continuously monitor the position of the second section 104B relative to the first section 104A. The anchor and power sub 104A and 104B may be used to bring the coring bit 116 into positional alignment with geological features of the formation, which may be detected, for example, by the near wellbore imaging tool 110.

The telemetry tool 106 may comprise electronics configured to provide power conversion between the cable 102 and the multiple components in the tool string 100, as well as to provide data communication between the surface electronics and processing system and the tool string 100. The inclinometry tool 108 may comprise magnetometers, accelerometers, and/or other known or future-developed sensors. The data provided by these sensors may be used to determine an orientation of the tool string 100, such as with respect to the magnetic North direction and/or the inclination of the tool string 100 with respect to the gravitational field of the Earth.

The near wellbore imaging tool 110 may be or comprise a resistivity imaging tool, for example, as described in U.S. Pat. Nos. 4,468,623, 6,191,588 and/or 6,894,499, each incorporated herein by reference in their entirety. The near wellbore imaging tool 100 may additionally or alternatively comprise an ultrasonic imaging tool, such as described in U.S. Pat. No. 6,678,616, the entirety of which is incorporated herein by reference. The near wellbore imaging tool 100 may additionally or alternatively comprise an optical/NIR (near infrared) imaging tool, such as described in U.S. Pat. No. 5,663,559, the entirety of which is incorporated herein by reference. The near wellbore imaging tool 100 may additionally or alternatively comprise a dielectric imaging tool, such as described in U.S. Pat. No. 4,704,581, the entirety of which is incorporated herein by reference. The near wellbore imaging tool 100 may additionally or alternatively comprise an NMR (nuclear magnetic resonance) imaging tool, such as described in PCT Publication No. 03/040743, the entirety of which is incorporated herein by reference. The near wellbore imaging tool 110 may be used together with the anchor and power sub 104. For example, the anchor and power sub 104A and 104B may be actuated to align sensing areas of the imaging tool 110 with selected portions of the wellbore wall 101. A measurement may be taken by the imaging tool 110 at multiple positions along the wellbore wall 101. In addition, relative positions of the first and second sections 104A, 104B of the anchor and power sub 104 may also be measured with respect to each of the measured multiple positions. A formation image may then be produced from the measurements. Once the image is produced, geological features (e.g., beds, fractures, inclusions) may be identified.

The lithology tool 112 may comprise nuclear spectroscopy sensors configured to determine concentrations of one or more elements in the formation. The lithology tool 112 may be implemented, for example, as described in U.S. Pat. Nos. 4,317,993 and/or 5,021,653, both of which are incorporated herein by reference in their entirety. The lithology tool 112 may be used to provide additional information about the mineralogy content of the geological features detected on the image produced with the near wellbore imaging tool 110. For example, the anchor and power tool 104 may be actuated to align sensors of the lithology tool 112 with a particular geological feature. A measurement may be taken by the lithology tool 112 and concentrations of one or more elements of the particular geological feature may then be determined.

The sidewall coring tool 114 comprises a core storage section 120 and a drilling section 118. The drilling section 118 comprises a coring bit 116 configured to fit into the coring tool 114 in a retracted position. The coring bit 116 is configured to extend beyond the coring tool body outer surface and into the wellbore wall 101 (sidewall) in an extended position (shown). Moreover, the coring bit is configured to obtain core samples at one or more angles that are not perpendicular to the longitudinal axis of the sidewall coring tool 114.

Figure 2:
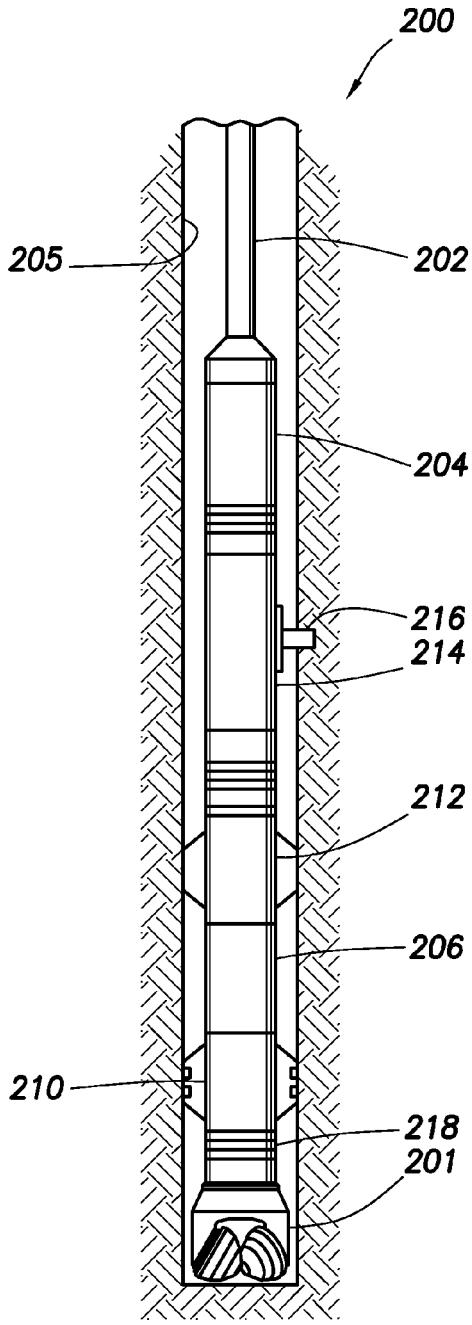
FIG. 2 is a schematic view of apparatus according to one or more aspects of the present disclosure.

Referring to FIG. 2, illustrated is a schematic view of a bottom hole assembly ("BHA") 200 attached at the end of a drill string 202 according to one or more aspects of the present disclosure. The BHA 200 comprises a sidewall coring assembly 214 having a coring bit 216. Like the wireline sidewall coring tool 114 shown in FIG. 1, the "while-drilling" sidewall coring assembly 214 shown in FIG. 2 is configured to obtain core samples at one or more angles that are not perpendicular to the longitudinal axis of the coring assembly 214 and/or the BHA 200.

The drill string 202 comprises a central bore therethrough to circulate drilling fluid or mud from the surface towards a drill bit 201. Pressure pulses may be generated in the drilling fluid column inside the drill string 202 to convey signals (encoding data and/or commands) between a surface system (not shown) and various tools or components in the BHA 200. Alternatively, or additionally, the drill string 202 may comprise wired drill pipe.

In addition to the sidewall coring assembly 214, the BHA 200 may comprise a drill bit 201, a near wellbore imaging tool 210, a directional drilling sub 206, a lithology analysis tool 212, and/or a measurement/logging while drilling ("MWD/LWD") tool 204. The MWD/LWD tool 204 may comprise a mud turbine generator (not shown) powered by the flow of the drilling fluid and/or battery systems (not shown) for generating electrical power to components in the BHA 200. The MWD/LWD tool 204 may also comprise capabilities for communicating with surface equipment. The MWD/LWD tool 204 also comprises one or more devices or sensors or measuring or detecting weight-on-bit, torque, vibration, shock, stick-slip, direction (e.g., a magnetometer), inclination (e.g., an accelerometer), and/or gamma rays.

The near wellbore imaging tool 210 may comprise one or more current-measuring electrodes. The current may be generated in the BHA 200 by a coil 218 of the near wellbore imaging tool 210. The current may then exit the BHA 200 (e.g., at the drill bit 201) and may return to the BHA 200 through the one or more electrodes of the near wellbore imaging tool 210. The current at the electrodes may be measured as the BHA 200 is disposed within the formation for drilling, as the BHA 200 is rotated within the formation, and/or as the BHA 200 is tripped out of the formation. Thus, resistivity images of the formation may be generated from data collected by the near wellbore imaging tool 210, such as with relation to the wellbore depth and/or the BHA 200 orientation within the wellbore.

The near wellbore imaging tool 210 may be similar to those described in U.S. Pat. No. 5,235,285 and U.S. Patent Publication No. 2009/0066336, both of which are incorporated herein in their entirety. An example lithology analysis tool suitable for drilling operations is described in U.S. Pat. No. 7,073,378, hereby incorporated by reference in its entirety. The BHA 200 may additionally or alternatively comprise other imaging tools, such as an ultrasonic imaging tool, an optical/NIR imaging tool, a dielectric imaging tool, and/or an NMR imaging tool, each disclosed above.

Referring to FIGS. 3A-3D, multiple side views of a downhole tool 321 according to one or more aspects of the present disclosure are shown. As with the apparatus shown in FIGS. 1 and 2 and described above, the downhole tool 321 comprises a coring assembly 323 having a motor 325 and a coring bit 327 operatively coupled to the motor 325. The motor 325 is attached to an end of the coring assembly 323. The motor 325 may be disposed horizontally adjacent to the coring bit 327 (as shown) or vertically adjacent (above or below) the coring bit 327. The coring bit 327 is configured to slide axially and rotate with respect to the coring assembly 323. The motor 325 is configured to drive the coring bit 327 such that the coring bit 327 rotates and penetrates into the formation to obtain a core sample.

The downhole tool 321 comprises a tool housing 341 extending along a longitudinal axis 300 of the tool 321. The coring assembly 323 and a storage area 361 are disposed within the tool housing 341. The tool housing 341 also comprises a coring aperture 343 defined therein.

As discussed above, the coring bit 327 is disposed within the downhole tool 321 such that the coring bit 327 is movable between multiple positions with respect to the downhole tool 321. The downhole tool 321 comprises rotation link arms 345 and a rotation piston 347 configured to rotatably mount the coring assembly 323 within the downhole tool 321. The rotation link arms 345 are pivotably coupled to the coring assembly 323. The rotation piston 347 is mounted within the tool housing 341 and is pivotably coupled to the rotation link arms 345. The piston 347 may be actuated to extend and/or retract, in which the movement of the piston 347 may be transferred to the rotation link arms 345 to correspondingly move (e.g., rotate) the coring assembly 323. As used herein, the terms "pivotably coupled" or "pivotably connected" may mean a connection between two tool components that allows relative rotating or pivoting movement of one of the components with respect to the other component, but may not allow sliding or translational movement of the one component with respect to the other.

Figure 3A:
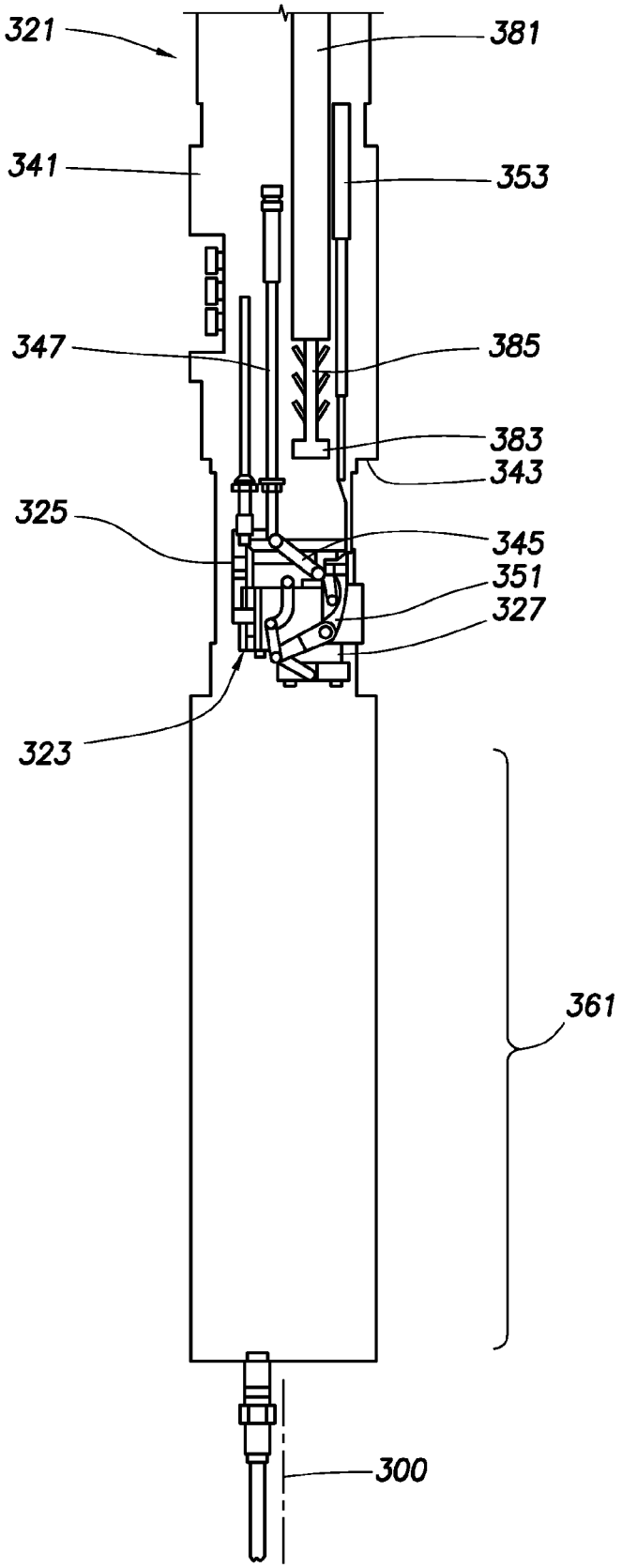
FIGS. 3A-3D are schematic views of apparatus according to one or more aspects of the present disclosure.
Figure 3B:
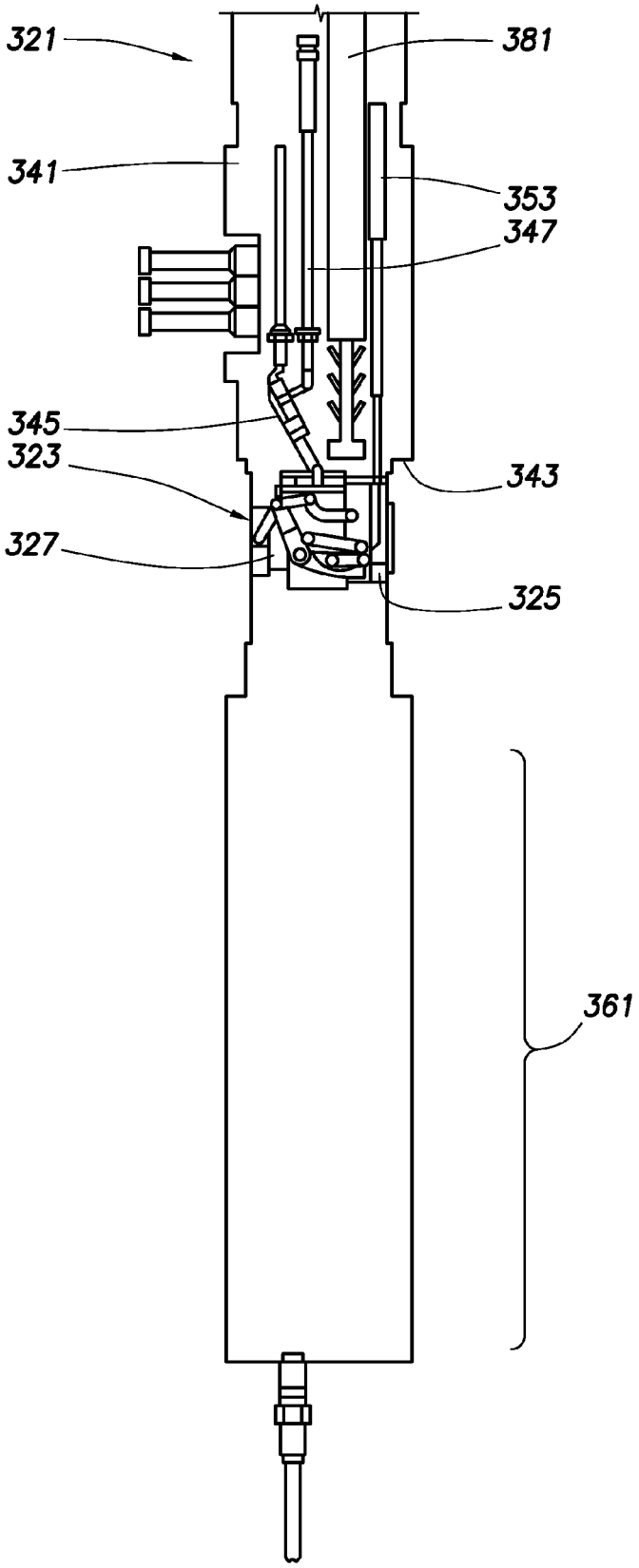

Extension of the rotation piston 347 correspondingly enables the rotation link arms 345 to rotate the coring assembly 323 and the coring bit 327 in the counter-clockwise direction, such as shown in a movement from FIG. 3B to FIG. 3A. Similarly, retraction of the rotation piston 347 correspondingly enables the rotation link arms 345 to rotate the coring assembly 323 and the coring bit 327 in the clockwise direction, such as shown in a movement from FIG. 3A to FIG. 3B. This arrangement enables the coring bit 327 to be movable between multiple positions with respect to the downhole tool 321.

Figure 3C:
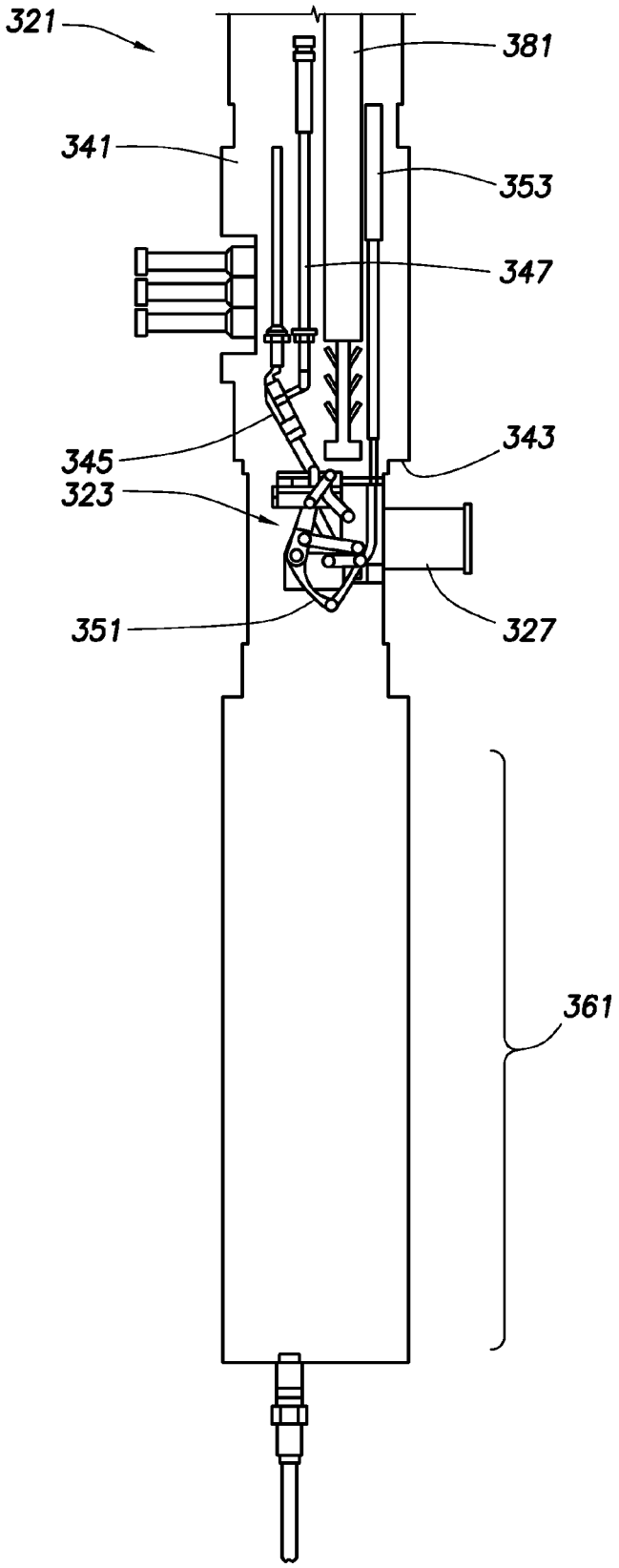
Figure 3D:
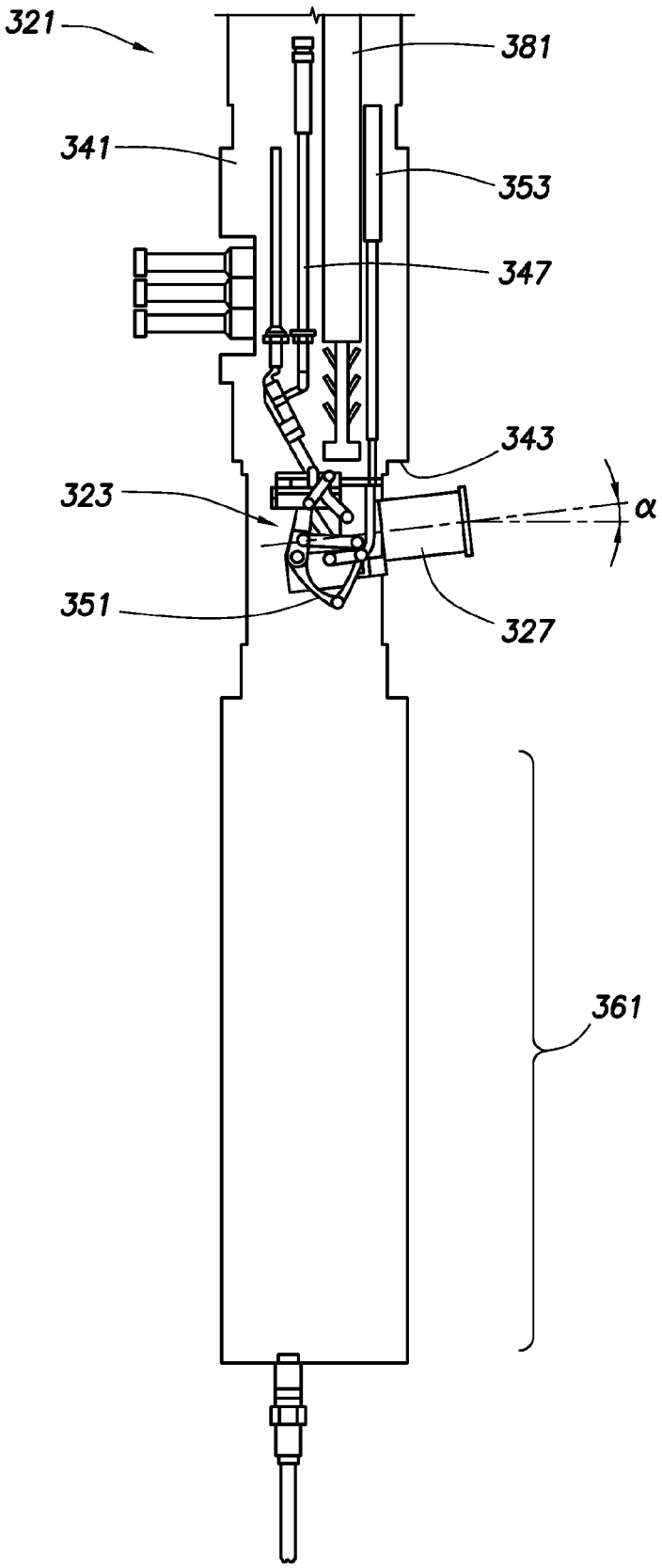

For example, the coring assembly 323 is able to move between coring positions and an eject position. In the coring positions, the coring bit 327 is disposed adjacent to the formation, such that the coring bit 327 may extend from the coring assembly 323 and penetrate into a wall of the formation. FIGS. 3B-3D show examples of the coring bit 327 disposed in coring positions. In the coring positions, the coring bit 327 may be disposed substantially perpendicular to the longitudinal axis 300 of the downhole tool 321, and/or the coring bit 327 may be disposed at an angle with respect to the longitudinal axis 300 of the downhole tool 321 (such that the coring bit 327 is not disposed substantially perpendicular to the longitudinal axis 300 of the downhole tool 321). In the coring positions, the coring bit 327 can extract a core sample from the formation. In the eject position, the coring bit 327 is disposed substantially parallel to the longitudinal axis 300 of the downhole tool 321. FIG. 3A shows an example of the coring bit 327 disposed in the eject position.

When the coring bit 327 is in a coring position, the coring bit 327 may be able to extend and retract from the downhole tool 321, such as shown through the movement of the coring bit 327 in FIGS. 3B-3D. For example, extension link arms 351 and an extension piston 353 are provided within the downhole tool 321 for extending and retracting the coring bit 327 from the downhole tool 321. The piston 353 is configured to extend and/or retract, and such movement is transferred to the extension link arms 351 to correspondingly move (e.g., extend and/or retract) the coring bit 327 from the coring housing 325. Thus, in a coring position, the open end of the coring bit 327 registers with the coring aperture 343 of the tool housing 341, while in the eject position, the open end of the coring bit 327 registers with the storage area 361. As used herein, the term "register" may be used to indicate that voids or spaces defined by two components, such as the open end of the coring bit and the storage area and/or the coring aperture, may be substantially aligned with each other.

The downhole tool 321 further comprises a system to handle and/or store multiple core samples, in conjunction with the storage area 361 in which core samples may be stored until the coring tool is brought to the surface.

The downhole tool 321 and components thereof may be configured to operate independently from each other. For example, rotation of the coring housing 325 can be independent from the extension and retraction of the coring bit 327. That is, the rotation system comprising the rotation link arms 345 and the rotation piston 347 can operate independently from the extension system comprising the extension link arms 351 and the extension piston 353. Thus, the coring bit 327 can extend and/or retract from the coring housing 325 regardless of the rotation position of the coring housing 325. As such, the coring bit 327 may be extended and/or retracted to capture core samples from a formation at multiple positions and/or multiple angles (such as an angle across a diagonal plane) with respect to the downhole tool 321. This independence enables the coring bit 327 to capture core samples at various angles with respect to the downhole tool 321.

Those having ordinary skill in the art will appreciate that, in addition to the above embodiments shown and described above with respect to a coring tool, other arrangements and mechanisms may be used to enable a coring assembly and/or a coring bit to move between multiple positions within a coring tool without departing from the scope of the present disclosure. Additional examples of mechanisms that may be used within a coring tool are disclosed within U.S. Pat. Nos. 4,714,119, 5,667,025, and 6,371,221, which are incorporated herein by reference in their entirety.

Figure 4A:
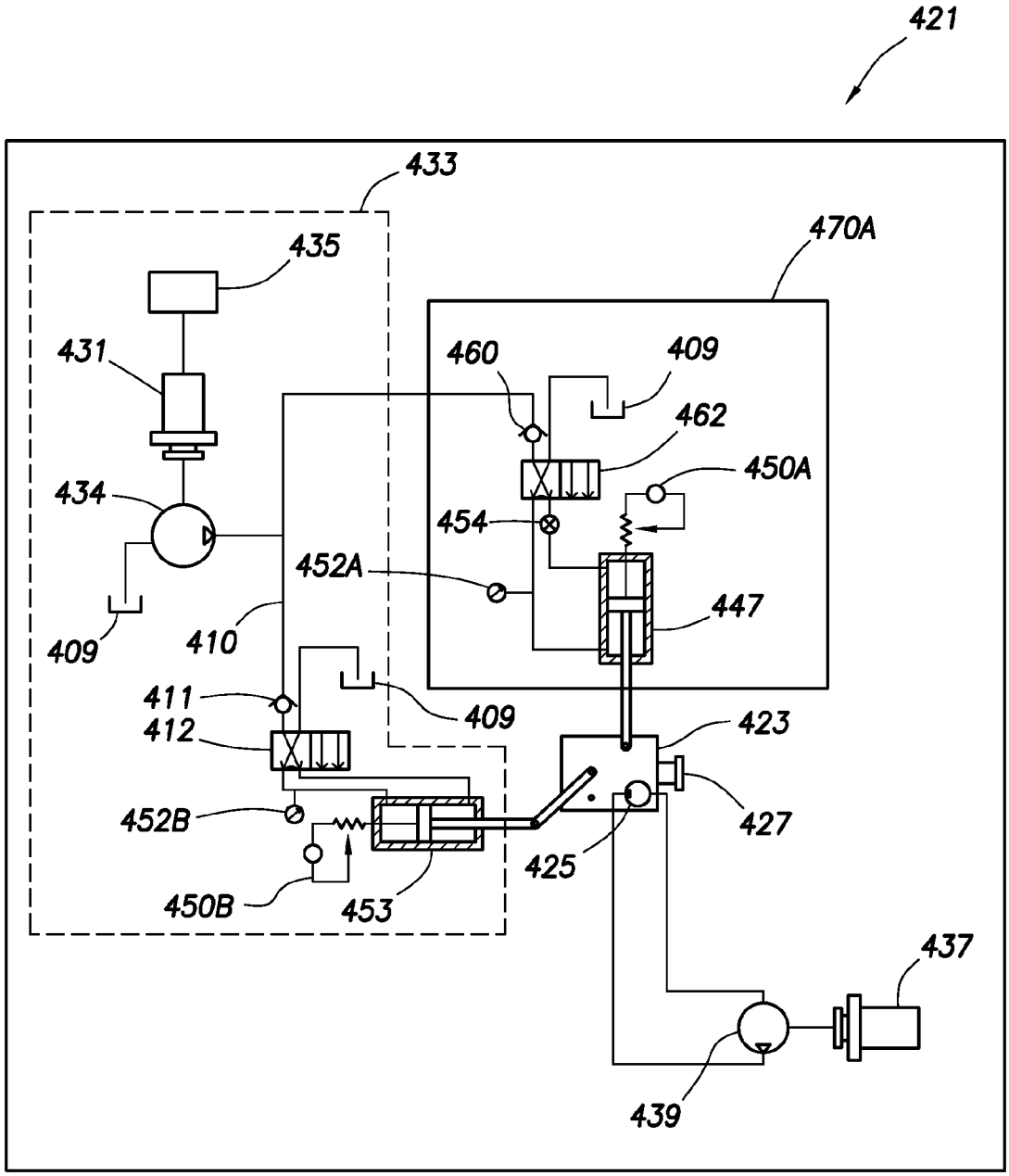
FIGS. 4A and 4B are schematic views of apparatus according to one or more aspects of the present disclosure.
Figure 4B:
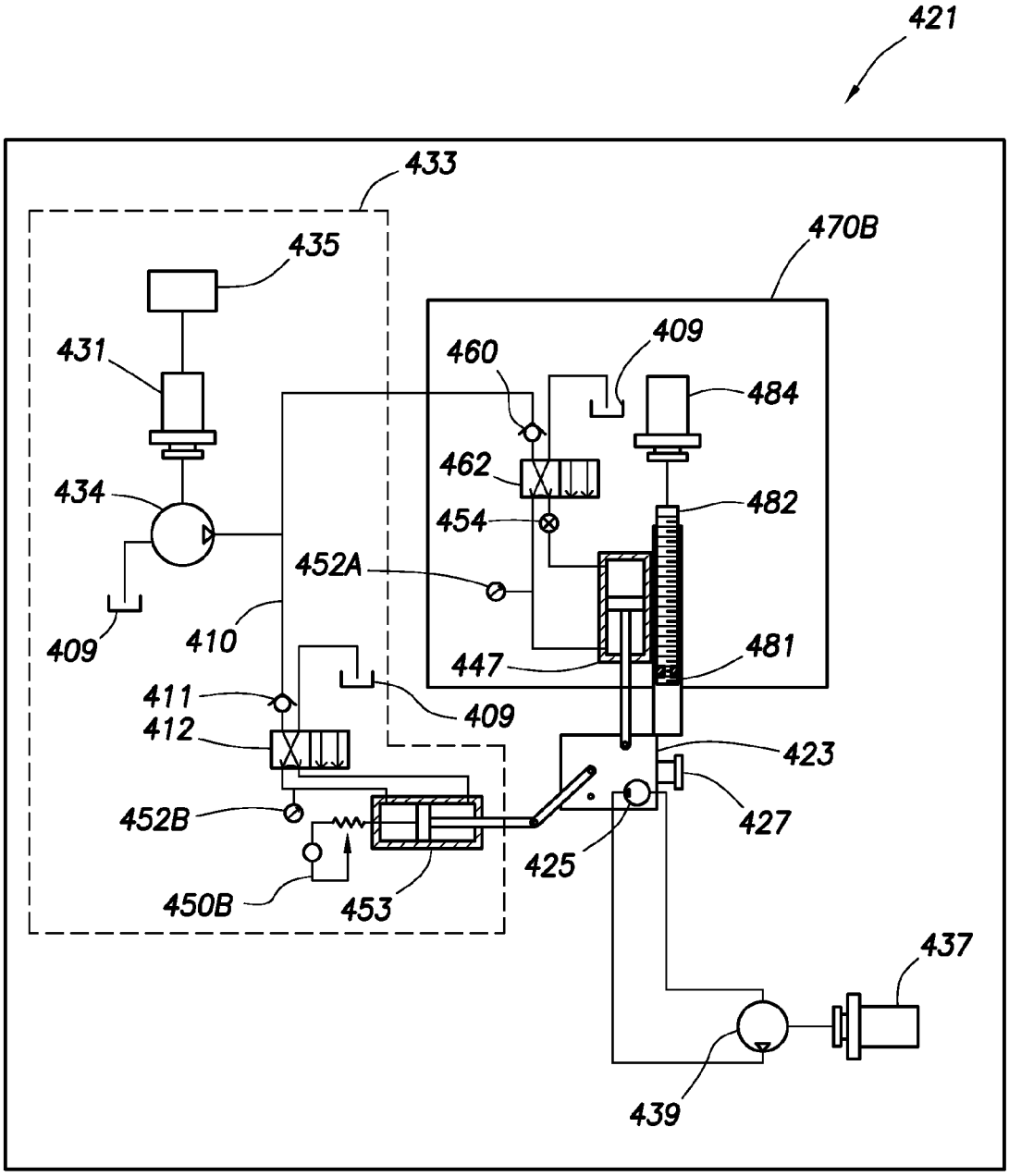

Referring to FIGS. 4A and 4B, illustrated are schematic views of a downhole tool 421 according to one or more aspects of the present disclosure. The downhole tool 421 may be substantially similar or identical to the tool 321 shown in FIGS. 3A-3D. For example, as with the above embodiments, the downhole tool 421 comprises a coring assembly 423 having a coring motor 425 and a coring bit 427 operatively coupled to the motor 425. The motor 425 is configured to drive the coring bit 427 such that the coring bit penetrates into the formation to obtain a core sample.

The downhole tool 421 comprises a control assembly 433 configured to control the driving and/or extending of the coring bit 427 into the formation, such as when the coring bit 427 is being pressed against and into the formation while also being rotated. The control assembly 433 may include an electric motor 431, a hydraulic pump 434, a controller 435, and a piston 453. The motor 431 may be used to supply power to the hydraulic pump 434, in which the flow of hydraulic fluid from the pump 434 may be controlled and/or regulated by the controller 435. Fluid may flow through hydraulic line 410, a one-way valve 411 and a multiple position valve 412, such as a four port two position valve, to communicate with the piston 453. A pressure gauge 452B may indicate the amount of pressure applied to the piston 453. Pressure from the hydraulic fluid from the pump 434 may be used to drive the piston 453 to apply a weight on bit (WOB) upon the coring bit 427. The piston 453 may be extended or retracted to insert the coring bit 427 into the formation and to retrieve a core sample from the formation.

Torque for the coring bit 427 may be supplied by a motor 437 and a pump 439. The motor 437 may be an AC motor, a brushless DC motor, and/or any other power source. The motor 437 may be used to drive the pump 439, which may supply a flow of hydraulic fluid to the coring motor 425. As such, the coring motor 425, which thus may be a hydraulic coring motor, may impart a torque to the coring bit 427 that rotates the coring bit 427, such as when drilling or coring with the coring bit 427.

The downhole tool 421 comprises a coring angle control system 470A configured to control and set a coring angle of the coring assembly 423 prior to drilling a core sample. In The piston 447 is configured to rotate the coring bit 427 to a determined coring angle. Hydraulic fluid to power piston 447 may be supplied thereto, such as by control system 433 previously described. Hydraulic fluid may flow to piston 447 through a one-way valve 460 and a multiple position valve 462 to power piston 447. Fluid pressure in the piston 447 may also be monitored by a pressure gauge 452A. A control valve 454 and a position sensor 450A may be used in conjunction to maintain the coring bit 427 at the desired coring angle, such as while drilling core samples with the coring bit 427. To do so, the position of piston 447 may be monitored and converted into a coring angle (i.e., the linear movement of the piston 447 may be converted and/or correlated with rotational movement of the coring bit 427). Once the position of piston 447 corresponds to the desired coring angle, control valve 454 may be closed to prevent movement of piston 447 and maintain the coring bit 427 at the desired coring angle. The piston 453 may also have a position sensor 450B coupled to the piston 453. The position sensor 450B may similarly be used to monitor the position of piston 453. The downhole tool 421 may also comprise one or more fluid reservoirs 409 configured to facilitate movement of fluid within the downhole tool 421.

FIG. 4B shows an alternative configuration of the downhole tool 421 that includes a coring angle control system 470B configured to control the coring angle of the coring bit 427 prior to drilling a core sample. The piston 447 is configured to rotate the coring assembly 423 as described above. The control system 470B comprises a handling piston 481 configured to limit rotation of the coring tool assembly 423 at a desired coring angle. The handling piston 481 may be or comprise a ball screw (or lead screw 482), and may be coupled to motor 484. Extension of the handling piston 481 may be monitored by a sensor (such as a resolver included with the motor 484). The handling piston 481 may be controllably extended into a position selected to obstruct the rotation of the coring bit 427 past a desired coring angle. The linear extension of the handling system may be converted and/or correlated with an angular rotation of the coring assembly 423. Once the handling piston 481 is extended and set, the coring bit 427 may then be rotated until the coring bit 427 abuts the handling piston 481. Abutment of the coring bit 427 with the handling piston may thus prevent the coring bit 427 from rotating further. At this point, the coring bit 427 may be aligned at the desired coring angle and may then be extended into the formation to obtain a core sample.

Figure 5:
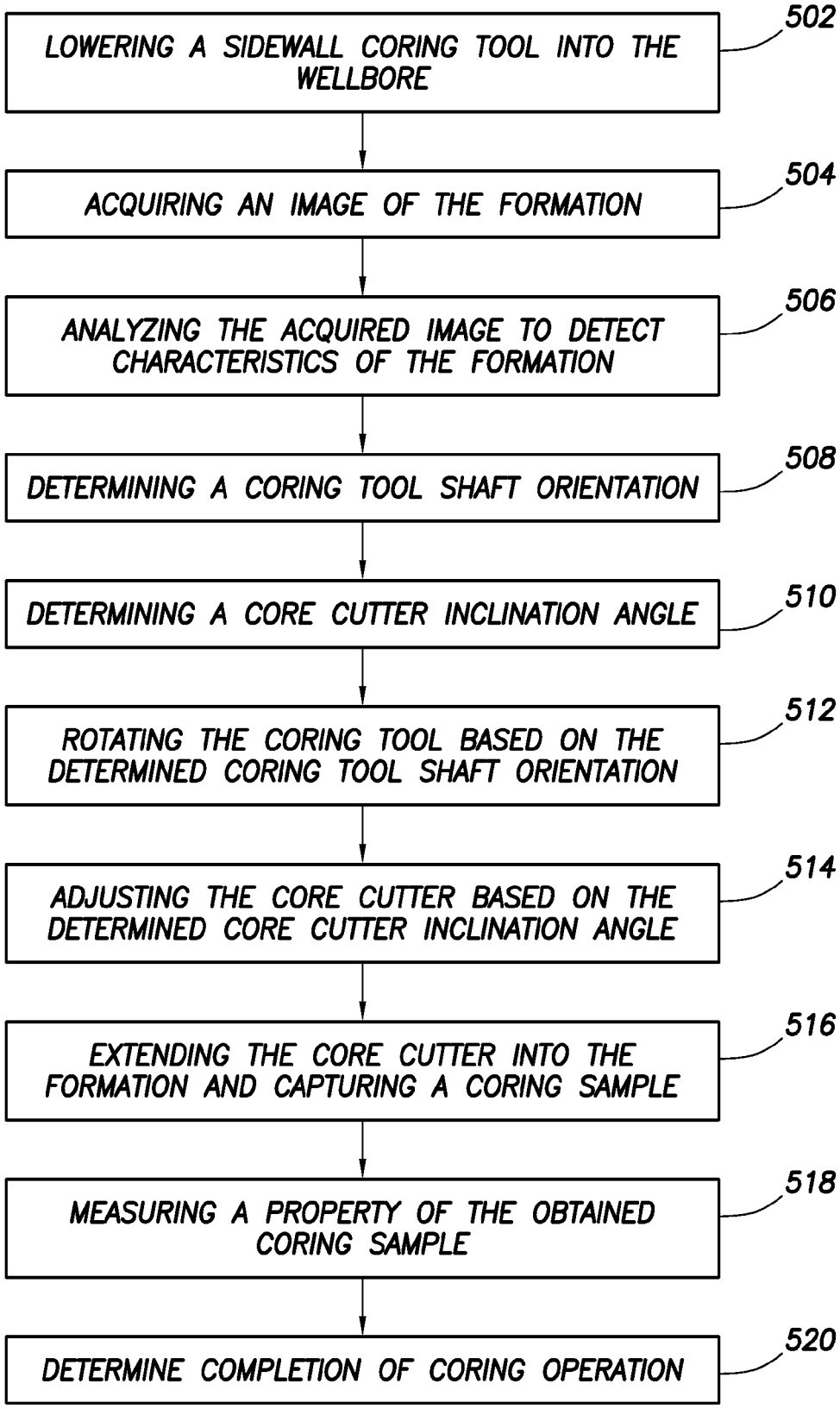
FIG. 5 is a flow-chart diagram of a method according to one or more aspects of the present disclosure.

Referring to FIG. 5, illustrated is a flow-chart diagram of at least a portion of a method of obtaining core samples from a sidewall of a formation according to one or more aspects of the present disclosure. A sidewall coring tool may be lowered into the wellbore using any of the conveyance methods discussed previously and/or using a downhole tool according to one or more aspects described above.

In a step 502, the sidewall coring tool is lowered into the wellbore in conjunction with a near wellbore imaging tool. Means for controllably locating the sidewall coring tool at a particular location in the well are provided, and may include an anchor and power sub (e.g., as shown in FIG. 1) or a drill string with an MWD/LWD tool (e.g., as shown in FIG. 2).

In a subsequent step 504, an image of a particular location of the formation near the wellbore and/or the formation wall may be acquired. For example, a formation image near the wellbore may be measured (i.e., a measurement of the formation up to a few inches deep from the sidewall may be taken), as the sidewall core samples may be shallow. If extended reach sidewall core samples (i.e., sidewall core samples extending deeper into the formation from the sidewall) are sought (see for example PCT Publication No. 2007/039025, incorporated herein by reference in its entirety), deeper imaging tools may alternatively or additionally be used.

In a subsequent step 506, the acquired formation image may be analyzed to detect geological features of the formation. Geological features may include fractures, bedding planes, stylolites, cross-beds, vugs, faults, and/or other geological features of interest that may be included or present within the formation. One method to analyze such an image is described in U.S. Pat. No. 7,236,887, incorporated herein by reference in its entirety. Analyzing the formation image may also be performed using Schlumberger Technology Corporation's Porospect (described for example in "Analysis of Carbonate Dual Porosity System from Electrical Images" by B. M. Newberry, L. M. Grace and D. D. Stief, SPE 35158, March 1996, incorporated herein by reference in its entirety). A lithology tool may be used to measure the mineralogy of the geological features analyzed from the acquired image (e.g., formation beds). Mineralogy properties may be used to decide on a particular portion of the formation to be sampled (e.g., sandstone beds, stylolites, shales).

After the formation image has been analyzed and properties of the formation are known, a coring bit orientation may be determined in step 508 based on the known properties of the formation (acquired and analyzed in previous step 506). For example, the image and data previously acquired and analyzed may indicate a specific position or location along a circumference of the formation sidewall in which resides a section or plane of interest (a section or plane of the formation to be sampled). From this determined location of interest along the circumference of the formation sidewall, a desired orientation for the coring tool and/or the coring bit may be determined, such as a desired orientation that may align the coring bit with the location of interest. For example, an orientation of the coring tool and/or the coring bit may be determined such that the coring tool and/or the coring bit within the coring tool may be disposed at a desired depth and/or a desired rotation such as to align with the determined location of interest within the formation sidewall.

Figure 6:
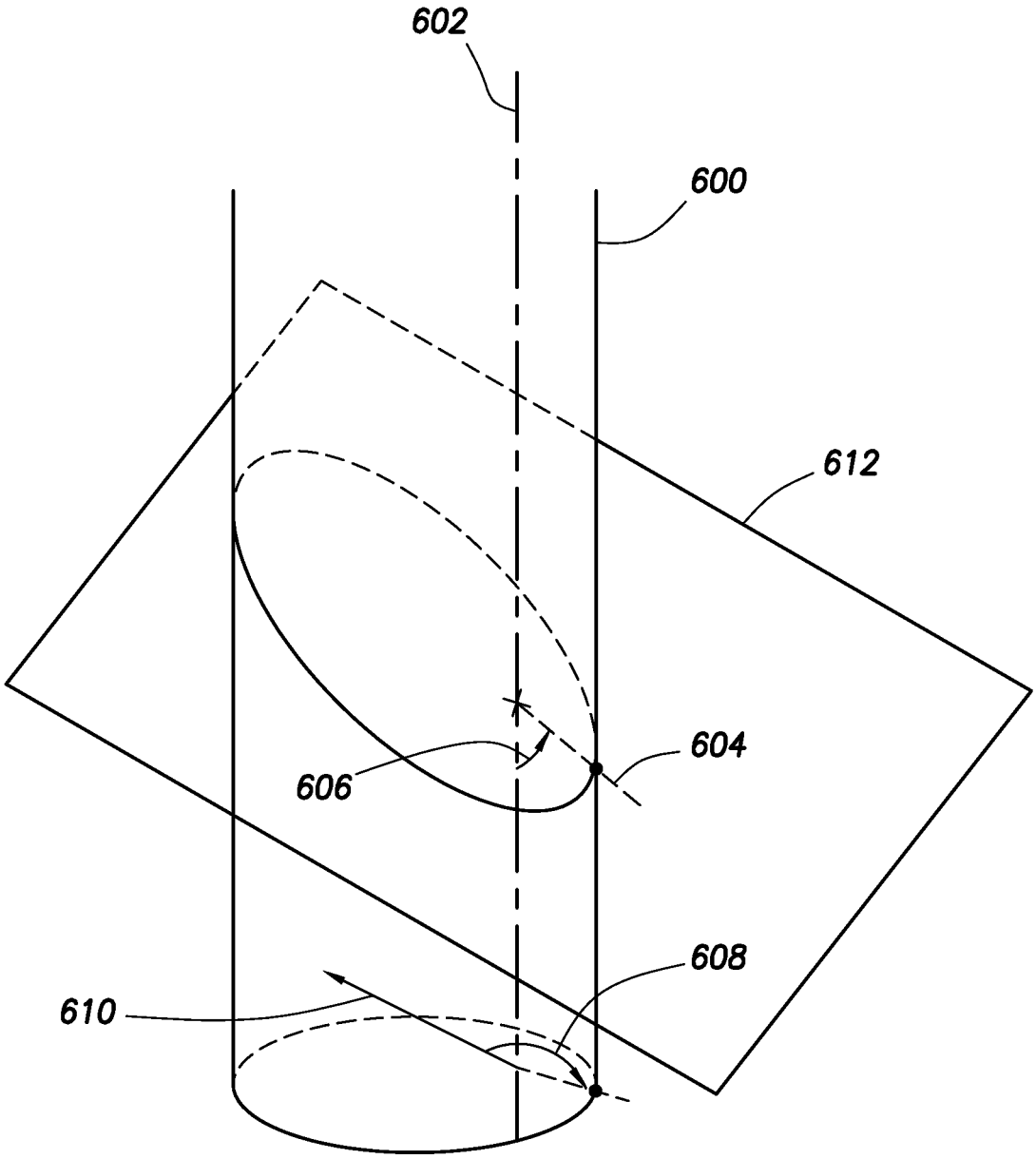
FIG. 6 is a schematic view demonstrating one or more aspects of the present disclosure.

For example, FIG. 6 is a schematic view of a wellbore 600 demonstrating one or more aspects of the present disclosure. A coring tool, such as those described above, disposed in the wellbore 600 may comprise a longitudinal axis 602 extending through the wellbore 600, and may further include a coring direction 604 for a coring bit. The coring direction 604 may be disposed at a desired coring angle 606 with respect to the axis 602, and the coring tool may have a desired coring shaft orientation 608, in which the coring shaft orientation 608 may be measured about the axis 602, such as with respect to a magnetic field 610 within the wellbore 600 (such as with respect to the magnetic North direction of the Earth). Accordingly, based upon these multiple degrees of freedom for the coring tool, such as desired angle 606 and orientation 608 for the coring tool, the coring tool may have a coring direction that may be able to align with a determined location (or plane) of interest 612, such as a bedding plane within the formation.

Returning to FIG. 5, after an orientation for the coring tool and/or the coring bit is determined, the method 500 comprises a step 510 in which the coring tool is disposed at the depth of the location of interest and/or oriented (if needed), such as by rotation about the longitudinal axis of the coring tool, such that the coring bit is aligned with the location of interest along the circumference of the formation sidewall. If desired, downhole sensors may be used to provide real time measurements to confirm proper alignment of the coring tool.

Similarly, from the acquired and analyzed data previously obtained (such as within steps 504 and 506), a coring angle for the coring bit of the coring tool may also be determined based on formation properties in step 512. This step pertains to determining a proper angle of the coring bit and/or the coring assembly with respect to the central axis of the downhole tool (i.e., tilting the coring bit up or down). For example, as previously mentioned, it may be advantageous to minimize the need to re-cut (i.e., cut a second sample from a first sample) the core sample. In the presence of geological features such as beds or fractures, this may be achieved by taking a core sample from a location of interest, such as taking a core sample along the bedding or fracture plane (i.e., in the direction of certain features or properties of the formation). Similarly, the core sample may be taken orthogonally to a bedding or fracture plane. As such, the coring angle for the coring bit may be determined to position the coring bit at a proper angle relative to the central axis of the downhole tool, an angle at which the core sample may be taken (as mentioned above with respect to FIG. 6). It is apparent that this angle is not necessarily perpendicular to the coring tool axis, but may be taken at any angle along a 180 degree arc, relative to the central axis of the downhole tool. For example, as shown particularly in FIG. 3D, the coring bit 427 may be disposed at an angle $\alpha$ from perpendicular to a longitudinal axis of the downhole tool 321. As such, a core sample may be retrieved from the formation at the angle $\alpha$ from perpendicular to the axis of the downhole tool 321.

Once the proper coring bit angle is determined, the coring bit itself may be adjusted or tilted relative to the central axis of the downhole tool, if not already disposed at the desired angle, to align with properties of the formation, in step 514. A tilting mechanism according to one or more aspects of the present disclosure may be operated for such tilting of the coring bit. Once the coring tool is oriented properly in the wellbore (steps 508 and 510) and the coring bit is adjusted at a proper angle relative to the central axis of the downhole tool (steps 512 and 514), the coring bit may be extended and inserted into the formation sidewall to capture the core sample in a step 516.

Once the core sample is captured, properties of the core sample may be measured in step 518. For example, a confirmation of the correct capture of the core sample may be obtained by performing an X-ray scan of the core sample in situ, together with other measurements such as acoustic impedance, Young's modulus and/or torsion modulus. Also, permeability anisotropy and compressive strength (or other properties) may be measured once the core sample is brought to the surface. In addition, the measurement step 518 may be used for quality control, i.e., to verify if the captured core sample has indeed been taken at a desired or proper angle relative to the central axis of the downhole tool (e.g., parallel to the bedding or fracture planes).

An optional step 520 may comprise determining whether the coring operation at the current location is finished. For example, the determination may be based on the measurement(s) performed in one or more previous steps. Depending on the determination, another attempt to capture a core sample may be made at the current location or an adjacent location. The coring angle used for the additional capture may be based on the measurements performed in one or more previous steps, and/or based on new wellbore images of a portion of the wellbore taken at a new location. Otherwise, other imaging operations may be performed, and/or the tool may be unset by retracting the coring bit and moving to another location.

One or more aspects of the present disclosure may provide for one or more of the following advantages. A tool and/or method within the scope of the present disclosure may be included within one or more of the embodiments shown in FIGS. 1-5, in addition to being included within other tools and/or devices that may be disposed downhole within a formation. Further, a tool and/or method within the scope of the present disclosure may be able to detect the presence of a core sample within a core sample holder before the core sample holder is disposed within the storage area of the coring tool. This may enable the coring tool to re-drill to attempt to retrieve a core sample for the core sample holder, thereby preventing an empty core sample holder from being disposed within the storage area of the coring tool. Furthermore, a tool and/or method within the scope of the present disclosure may be able to determine the length of a core sample within a coring tool. Furthermore, a tool and/or method within the scope of the present disclosure may be able to obtain core samples at angles other than perpendicular (90 degrees) with respect to the longitudinal axis of the downhole tool.

In view of all of the above and the figures, those skilled in the art should readily recognize that the present disclosure introduces a method comprising: lowering a downhole tool into a wellbore extending into a subterranean formation, wherein the downhole tool comprises a coring tool and a measurement tool; performing a measurement regarding the formation using the measurement tool; determining a section of interest within the formation relative to an axis of the coring tool based on the measurement; orienting a coring bit of the coring tool relative to the section of interest; and extending the oriented coring bit into the formation. Orienting the coring bit of the coring tool relative to the section of interest may comprise rotating the coring tool about the axis of the coring tool such that the coring bit is substantially radially aligned with the section of interest. Orienting the coring bit of the coring tool relative to the section of interest may comprise adjusting an inclination angle of the coring bit with respect to the axis of the coring tool such that the coring bit is substantially aligned with the section of interest. The method may further comprise capturing a core sample from the formation using the oriented coring bit. The method may further comprise measuring a property of the captured core sample using the downhole tool. The measurement tool may comprise a near wellbore imaging tool, wherein performing the measurement comprises using the near wellbore imaging tool to acquire an image of at least a portion of the formation, and wherein determining the section of interest is based on the acquired image. The measurement tool may comprise a lithology tool, wherein performing the measurement comprises using the lithology tool to acquire an image of at least a portion of the formation, and wherein determining the section of interest is based on the acquired image. The method may further comprise: determining an orientation of the coring tool within the formation; and determining an inclination of the coring bit with respect to the axis of the coring tool. Orienting the coring bit of the coring tool relative to the section of interest may comprise: rotating the coring tool about the axis of the coring tool such that the coring bit is substantially radially aligned with the section of interest; and adjusting an inclination angle of the coring bit with respect to the axis of the coring tool such that the coring bit is substantially aligned with the section of interest. Extending the oriented coring bit into the formation may comprise extending the coring bit into the formation at the inclination angle substantially aligned with the section of interest. Lowering the downhole tool into the wellbore may comprise lowering the downhole tool via wireline or drill pipe.

The present disclosure also introduces an apparatus comprising: a downhole tool configured for conveyance within a wellbore extending into a subterranean formation, wherein the downhole tool comprises a coring tool comprising: a sidewall coring assembly having a coring bit; an extension system configured to extend and retract the coring bit from the sidewall coring assembly; and a rotation system configured to rotate the sidewall coring assembly relative to the coring tool; wherein the extension system and the rotation system are independently operable. The coring bit may be configured to extend at a non-perpendicular angle with respect to an axis of the sidewall coring assembly to capture a core sample. The extension system may comprise an extension piston and an extension link arm collectively configured to extend and retract the coring bit from the sidewall coring assembly. The rotation system may comprise a rotation piston and a rotation link arm collectively configured to rotate the sidewall coring assembly with respect to an axis of the sidewall coring assembly. The apparatus may further comprise a position sensor and a controller coupled to at least one of the extension system and the rotation system. The apparatus may further comprise a coring angle control system configured to maintain the coring bit at a desired coring angle with respect to an axis of the sidewall coring assembly. The coring angle control system may comprise a handling piston configured to abut a housing within which the coring bit is disposed. The coring angle control system may comprise a valve coupled to a piston of the rotation system, wherein the valve is configured to prevent movement of the piston.

The foregoing outlines feature several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured for conveyance within a wellbore extending into a subterranean formation, wherein the downhole tool comprises a coring tool comprising:

a sidewall coring assembly having a coring bit;

an extension system configured to extend the coring bit from the sidewall coring assembly at a plurality of angles with respect to an axis of the downhole tool; and a rotation system configured to rotate the sidewall coring assembly to each of the plurality of angles, wherein the rotation system comprises:

a hydraulic piston movable to rotate the coring bit to each of the plurality of angles; and a flow control valve operable to regulate fluid flow to the hydraulic piston based on a detected position of the hydraulic piston.

2. The apparatus of claim 1 wherein the coring bit is configured to extend at a non-perpendicular angle with respect to an axis of the sidewall coring assembly to capture a core sample.

3. The apparatus of claim 1 wherein the extension system comprises an extension piston and an extension link arm collectively configured to extend and retract the coring bit from the sidewall coring assembly.

4. The apparatus of claim 1 wherein the rotation system comprises a rotation link arm configured to rotate the sidewall coring assembly with respect to an axis of the sidewall coring assembly.

5. The apparatus of claim 1 wherein the rotation system comprises a position sensor to determine a rotational position of the coring bit with respect to the axis of the downhole tool.

6. The apparatus of claim 1 wherein the rotation system comprises:

a position sensor to detect a position of the hydraulic piston; and a controller configured to determine an angular position of the coring bit based on the detected position.

7. The apparatus of claim 1 wherein the rotation system comprises a handling piston extendable to obstruct movement of the coring bit past a selected angle of the plurality of angles.

8. The apparatus of claim 1 wherein the rotation system comprises:

a position sensor to detect a position of the hydraulic piston; and a controller configured to move the hydraulic piston based on the detected position to maintain the coring bit at a selected angle of the plurality of angles during rotation of the coring bit.

9. An apparatus, comprising:

a downhole tool configured for conveyance within a wellbore extending into a subterranean formation, wherein the downhole tool comprises a coring tool comprising:

a sidewall coring assembly having a coring bit;

an extension system configured to extend the coring bit from the sidewall coring assembly at a plurality of angles with respect to an axis of the downhole tool; and a rotation system configured to rotate the sidewall coring assembly to each of the plurality of angles, wherein the rotation system comprises:

a piston movable to rotate the coring bit to each of the plurality of angles;

a position sensor to detect a position of the piston; and a controller configured to determine an angular position of the coring bit based on the detected position.

10. The apparatus of claim 9 wherein the coring bit is configured to extend at a non-perpendicular angle with respect to an axis of the sidewall coring assembly.

11. The apparatus of claim 9 wherein the extension system comprises an extension piston moveable to extend the coring bit from the sidewall coring assembly.

12. An apparatus, comprising:

a downhole tool configured for conveyance within a wellbore extending into a subterranean formation, wherein the downhole tool comprises a coring tool comprising:

a sidewall coring assembly having a coring bit;

an extension system configured to extend the coring bit from the sidewall coring assembly at a plurality of angles with respect to an axis of the downhole tool; and a rotation system configured to rotate the sidewall coring assembly to each of the plurality of angles, wherein the rotation system comprises:

a piston movable to rotate the coring bit to each of the plurality of angles;

a position sensor to detect a position of the piston; and a controller configured to move the piston based on the detected position to maintain the coring bit at a selected angle of the plurality of angles during rotation of the coring bit.

13. The apparatus of claim 12 wherein the coring bit is configured to extend at a non-perpendicular angle with respect to an axis of the sidewall coring assembly to capture a core sample.

14. The apparatus of claim 12 wherein the extension system comprises:

an extension piston moveable to insert the coring bit into the subterranean formation; and a pressure gauge configured to indicate an amount of pressure applied to the extension piston.

* * * * *